US009745030B2

(12) United States Patent
Bates

(10) Patent No.: US 9,745,030 B2
(45) Date of Patent: Aug. 29, 2017

(54) WATERSPORT SIGNALING DEVICES, SYSTEMS, AND METHODS

(71) Applicant: Lyle Bates, Lake Tapps, WA (US)

(72) Inventor: Lyle Bates, Lake Tapps, WA (US)

( * ) Notice: Subject to any disclaimer, the term of this patent is extended or adjusted under 35 U.S.C. 154(b) by 0 days.

(21) Appl. No.: 15/069,938

(22) Filed: Mar. 14, 2016

(65) Prior Publication Data

US 2016/0264219 A1 Sep. 15, 2016

Related U.S. Application Data

(60) Provisional application No. 62/133,297, filed on Mar. 14, 2015.

(51) Int. Cl.
*B63B 35/85* (2006.01)
*B63B 35/81* (2006.01)

(52) U.S. Cl.
CPC ..... *B63B 35/815* (2013.01); *B63B 35/85* (2013.01)

(58) Field of Classification Search
CPC ..... B63B 35/73; B63B 35/81; B63B 35/85; B63B 21/56; B63B 45/00; B63C 9/20
USPC ..... 116/173, 209; 114/253; 441/11
See application file for complete search history.

(56) References Cited

U.S. PATENT DOCUMENTS 2,943,591 A * 7/1960 Schneider ..... B63B 35/817 114/253
3,280,789 A * 10/1966 Lewis ..... B63B 22/00 116/173
4,123,813 A * 11/1978 Adams ..... B63B 22/22 116/173
4,640,213 A * 2/1987 Lugo ..... B63B 35/85 114/253
4,807,557 A * 2/1989 Lodisio ..... G08B 5/02 116/173
4,896,620 A * 1/1990 Jones ..... B63B 51/02 114/253
5,179,907 A * 1/1993 Galbraith ..... G09F 17/00 116/173
5,771,836 A * 6/1998 Crouse ..... G09F 17/00 116/173
7,013,823 B1 * 3/2006 Daugherty ..... B63B 35/815 114/253
7,428,879 B1 * 9/2008 White ..... B63B 21/56 114/253

* cited by examiner

*Primary Examiner* — Lars A Olson
(74) *Attorney, Agent, or Firm* — Stoel Rives LLP; Zhi-Xiang (Alex) Oh

(57) ABSTRACT

An alerting device can be attached to one or more tow lines for towing a watersport participant via a watercraft. In some instances, the alerting device can be spaced from the watersport participant and the watercraft during use. The alerting device can be deployed automatically, such as when tension in the one or more tow lines is reduced due to the participant being downed in the water so as to no longer be towed.

20 Claims, 16 Drawing Sheets

WATERSPORT SIGNALING DEVICES, SYSTEMS, AND METHODS

CROSS-REFERENCE TO RELATED APPLICATIONS

This application claims the benefit under 35 U.S.C. §119 (e) of U.S. Provisional Patent Application No. 62/133,297, titled WATERSPORT SIGNALING SYSTEMS AND METHODS, which was filed on Mar. 14, 2015, the entire contents of which are hereby incorporated by reference herein.

TECHNICAL FIELD

The present disclosure relates generally to devices, systems, and methods for deploying a safety signal, such as a flag, for watersports, such as waterskiing.

BACKGROUND

Water activities, which may also be referred to herein as watersports activities or marine sports, such as waterskiing, wakeboarding, water tubing, kneeboarding, etc., have an inherent danger from watercraft. Laws have been enacted to require signaling when a watersport participant is in the water after becoming disassociated from the sport activity (e.g., falling into the water and releasing a towline), which can leave the participant vulnerable to being impacted by other watercraft in the vicinity. A small flag (typically orange) is a traditional method of signaling a downed watersport participant, and this flag may be raised by an individual on the watercraft or in other manners.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

Signaling that a watersport participant is in a downed position is often achieved by a person raising a warning flag. The watersport participant may be in the water under a variety of conditions when in such a downed position, such as prior to participating in the watersport (e.g., while moving toward or initially gripping a handle or while getting onto a water tube) or after falling. Raising the warning flag signals that a watersport participant is downed (e.g., has fallen) and is vulnerable to being struck by another watercraft. An arrangement in which an individual in the watercraft manually raises a flag to signal the downed condition of the watersport participant suffers from the possibility of the flagger forgetting to raise the signal or signaling in a delayed manner, thus leaving the downed watersport participant in potential danger. Other known systems suffer from a variety of drawbacks, such as complicated mechanisms for detecting a downed watersport participant and/or raising of the flag. Many attempts to remedy problems for flag-raising have led to complicated and technical processes that are not conducive to successful or convenient systems or methods.

Various embodiments described herein, however, remedy, ameliorate, and/or otherwise address one or more of the problems associated with the prior art. For example, the watersport participant's safety can be improved by a timely deployment of a signaling device. Stated otherwise, it can be desirable to deploy the signal directly once the watersport participant becomes disassociated from the participating watersport activity (e.g., falls or otherwise ceases being towed by a watercraft). The signaling device can be directly responsive to the watersport participant and react to the absence of the watersport participant by raising the signal upon the participant becoming disassociated from the sport activity.

Certain embodiments described herein automatically signal that a watersport participant is downed in direct response to the downing of the participant. For example, in various embodiments, a signaling device is configured to transition from a deployed or signaling state, in which a flag or other signaling device is raised, to an undeployed or stowed state, in which the flag or other signaling device is lowered, in direct response to a reduction in tension on a towing line that results when a participant is no longer being towed via the towing line. Such an automatic and immediate response to the condition of the participant can be advantageous. Other or further advantages will be apparent from the disclosure herein.

Figure 1:
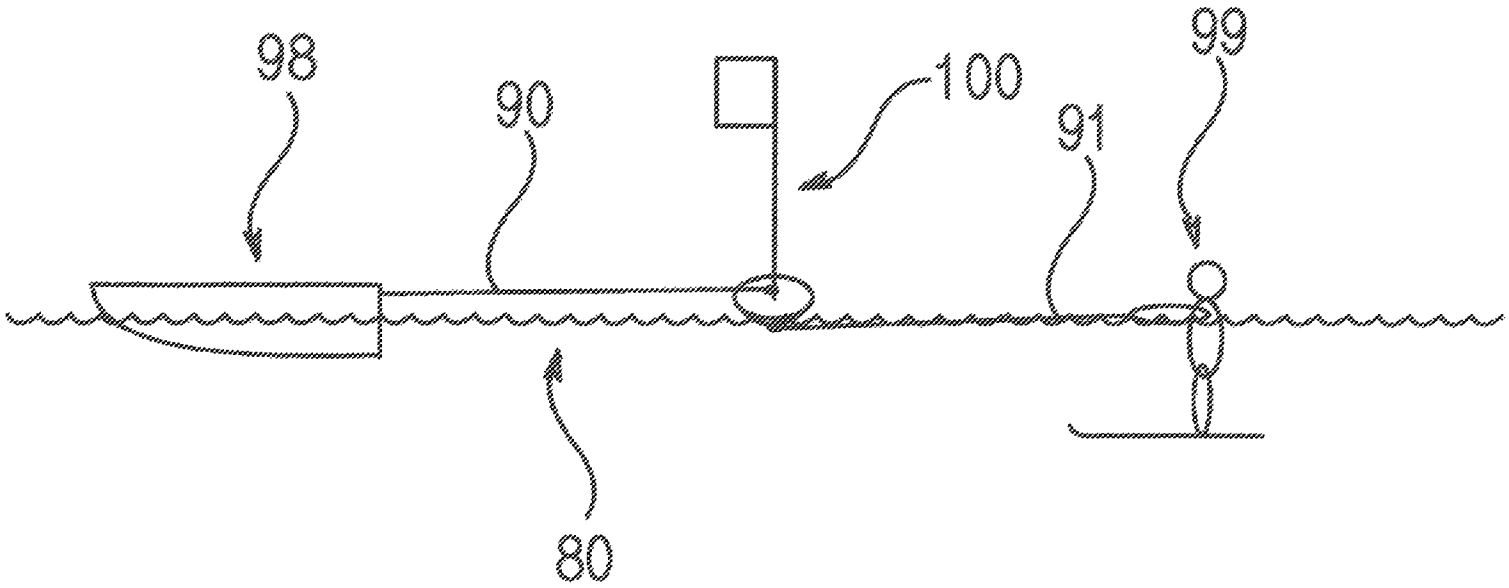
FIG. 1 is an elevation view of an embodiment of an alerting system or signaling system in a raised mode indicating that the watersport participant is down in the water.

FIG. 1 depicts a signaling system for use in a watersport or marine activity, such as waterskiing, wakeboarding, tubing, kneeboarding, etc. As previously discussed, it can be desirable, and in some instances, even mandated by law, to raise a warning flag or the like when a watersport participant is in a downed position in the water. The watersport participant may be in the downed position, for example, prior to being towed or after having fallen.

FIG. 1 depicts a watercraft 98, such as a boat, a watersport participant 99, and a signaling device 100, which may also be referred to as an alerting device. A tow line 90 can be secured to the watercraft 98 at a first end thereof and can be secured to the signaling device 100 at an opposite end thereof. In the illustrated embodiment, a further tow line 91 is secured to the signaling device 100 at one end thereof, and the watersport participant 99 can selectively hold onto an opposite end of the tow line 91, such as via a handle. Any suitable tow lines 90, 91 are contemplated. For example, standard water skiing tow lines, ropes, etc. may be used. As will be apparent from the discussion that follows, the tow lines 90, 91 and the signaling device 100 can operate together as a signaling or alerting system.

FIG. 1 depicts the participant 99 in a downed state. For example, the watercraft 98 may be relatively stationary as the participant 99 gets a grip on the tow line 91 prior to movement of the watercraft 98 to pull the participant 99 out of the water. When the participant 99 is not holding the tow line 91 (or the handle) and/or when the participant 99 is not being towed by the watercraft 98, the participant 99 is considered to be in a downed state. In other watersports, the participant 99 may not hold onto the tow line 91 directly, but may still be towed via the tow line 91. For example, the participant 99 may in some instances hold onto a tube (not shown), and the tube may be directly connected to the tow line 91. Should the participant 99 fall off of the tube and into the water, the participant would be in a downed state. Whether the participant holds onto the tow line 91 or is otherwise towed thereby, a distal end of the tow line 91 is generally the portion of the tow line 91 that is closest to the water participant. When the participant 99 is in the downed position, a flag portion of the signaling device 100 can be in a raised position to indicate this scenario. Stated otherwise, the signaling device 100 can be in a deployed, signaling, or raised state to indicate that the participant 99 is in a downed state.

Figure 2:
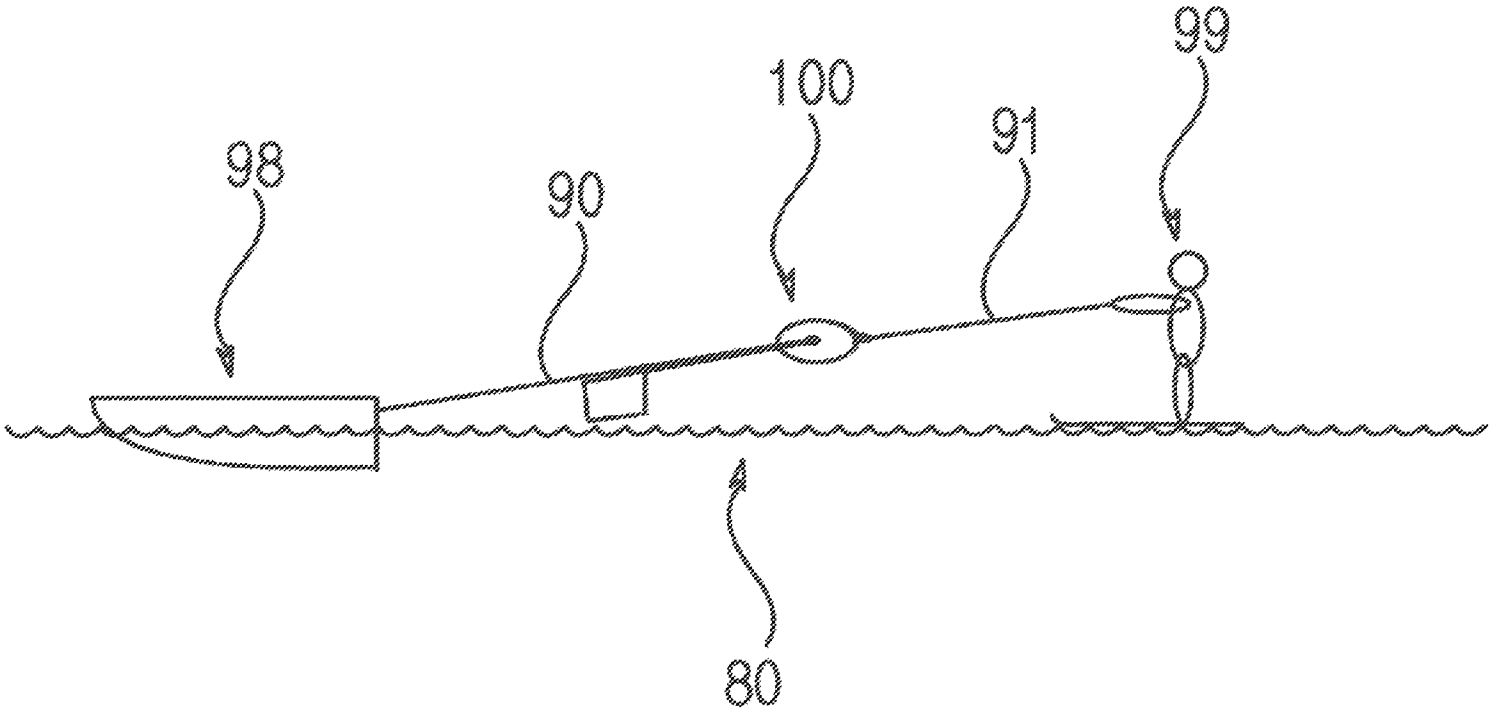
FIG. 2 is an elevation view of the signaling system of FIG. 1 in a lowered mode indicating that the watersport participant is out of the water and actively or dynamically being towed.

FIG. 2 depicts the signaling device 100 in a stowed, retracted, lowered, or undeployed orientation. As further discussed below, the signaling device 100 can be transitioned to this state as the participant 99 is pulled by the watercraft 98. Tension, or increased tension, that arises in the tow lines 90, 91 as the participant 99 is being towed can automatically transition the signaling device 100 to the lowered orientation.

For reference, a surface 80 of the water is identified in FIGS. 1 and 2. In general, the surface 80 generally defines a horizontal plane, although individual waves of varying size may assume a variety of shapes and orientations.

As can be seen in FIGS. 1 and 2, in each of the deployed and stowed configurations, the device 100 is spaced from each of the watercraft 98 and the participant 99. A towing force provided by the watercraft 98 is communicated to the participant 99 by or through the device 100.

Figure 3:
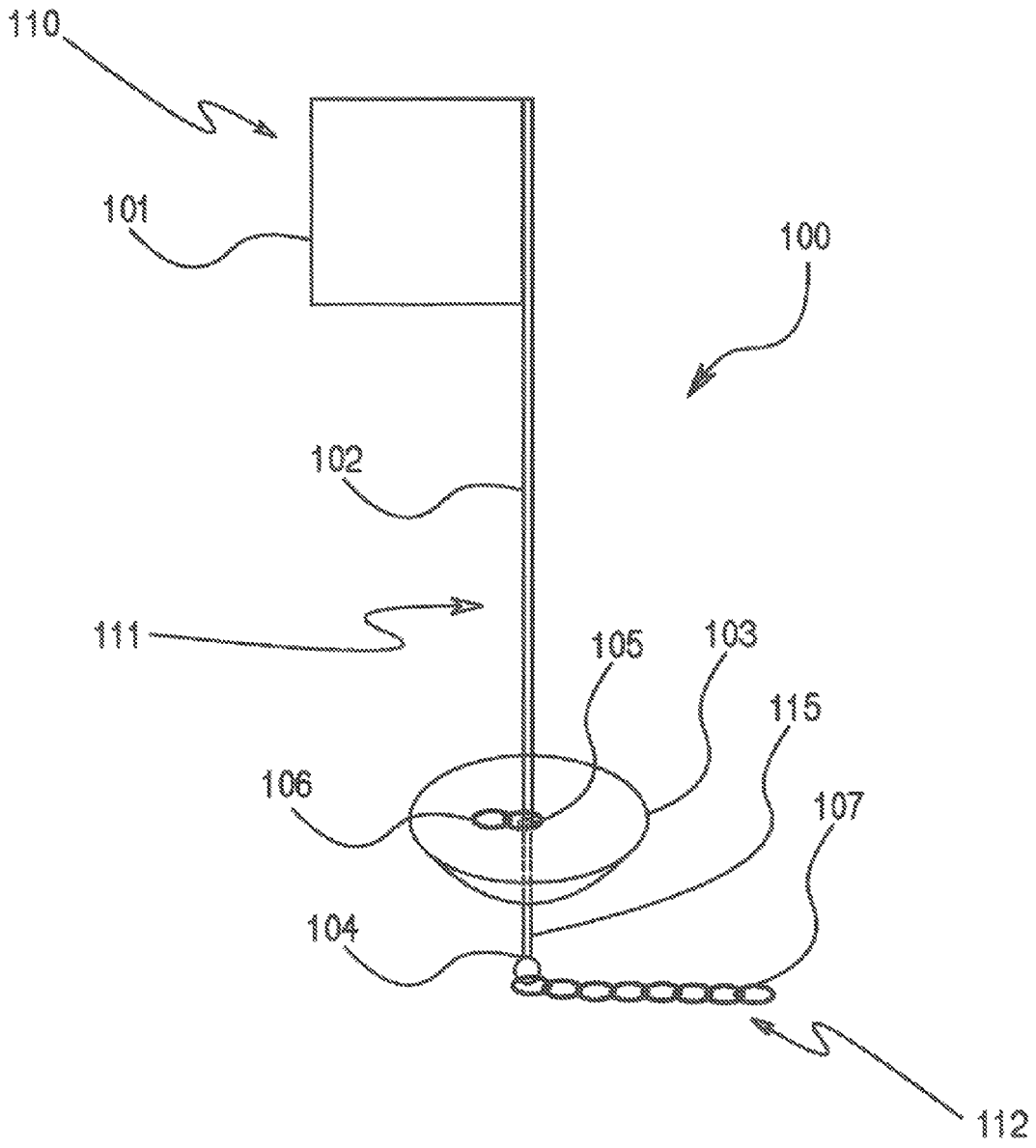
FIG. 3 is a perspective view of the signaling system of FIG. 1.

FIG. 3 depicts the signaling device 100 in greater detail. The illustrated device 100 includes a signaling member 110 attached to a post 111. The signaling member 110 can comprise a flag 101 (e.g., a signaling membrane) or other suitable signaling device. For example, the signaling member 110 can provide a visual warning of the downed state of the participant 99. In various embodiments, the signaling member 110 can comprise a vibrantly colored material, a reflective material (e.g., one or more reflectors), one or more lights, etc. In other or further embodiments, the signaling member 110 can provide an audible warning when the participant 99 is in the downed state.

In the illustrated embodiment, the post 111 comprises an elongated member, appendage, or pole 102, such as a hollow shaft or a solid rod. In other embodiments, the post 111 may have a different form, and need not be an elongated member. In the illustrated embodiment, the post 111 in the elongated form of a pole 102 may be advantageous in that a high profile above surface 80 of the water may be achieved when the device 100 is in the deployed state. Further, a low profile relative to the tow lines 90, 91 may be achieved when the device 100 is in the stowed state.

The illustrated post 111 is fixedly secured to a buoyant member 103, which can comprise a float of any suitable variety and/or can comprise any suitable low-density material. In the illustrated embodiment, the post 111 comprises a unitary piece that extends from an upper end of the device 100 to a lower end thereof and extends through the buoyant member 103. In other embodiments, the post 111 may instead be connected to an upper side of the buoyant member 103 in any suitable manner, such as via bracket or other fastening mechanism.

The buoyant member 103 can comprise any suitable buoyant material and may define any suitable shape. At least a portion of the buoyant member 103 can be positioned in the water to provide the device 100 with sufficient buoyancy to remain afloat when the device 100 is in the deployed configuration. In the illustrated embodiment, the buoyant member 103 is shaped substantially as a disk having a relatively planar upper surface and an angled or rounded lower surface. In some embodiments, a sloped lower surface of the buoyant member 103 can assist in maintaining the signaling device 100 in a raised state when the device is being towed by a watercraft 98 when the participant 99 is in a downed state (and is not being towed). In particular, the sloped lower surface can cause the buoyant member 103 to skim along the surface of the water, or stated otherwise, can interact with the surface of the water to bias the appendage toward a substantially vertical or upright orientation.

In the illustrated embodiment, the post 111 includes an upper connector 105 above the buoyant member 103 and terminates at a lower connector 104 below the buoyant member 103. In other embodiments, the post 111 may be attached to an extension at its lower end, such as an eyebolt. The eyelet of the eyebolt can define the connector 104. In some embodiments, the upper connector 105 is at or near the upper surface of the buoyant member 103, although the upper connector 105 can be spaced from the upper surface in other embodiments. In some embodiments, the lower connector 104 is at the lower surface of the buoyant member 103. In the illustrated embodiment, the lower connector 104 is spaced from the lower surface of the buoyant member 103. A line connection member 107 can be attached to the lower connector 104 and can be configured for attachment to the tow line 91. In the illustrated embodiment, the connection member 107, which may also be referred to as a connector, comprises a length of chain. The length and weight of the chain can be selected to assist in orienting the device 100 in the raised configuration when tension is either reduced or not present in the tow lines 90, 91 when the participant is in a downed position. Spacing the lower connector 104 from the buoyant member 103 can also assist in orienting the device 100 in the raised configuration. For example, a connection member 107 that comprises a heavy chain results in a weighted lower end of the device 100. Accordingly, in the illustrated embodiment, the connection member 107 comprises a weight 112. Other embodiments employ weights other than a chain. Any suitable weight 112 is contemplated. With little or no tension pulling the chain to a substantially horizontal orientation (or other orientation that corresponds with the tensioning of the tow lines 90, 91), the chain is permitted to be pulled downward by gravity. This downward force exerts a torque on the system to raise the flag. The torque may be increased by spacing the lower connector 104 from the buoyant member 103, and the device 100 may pivot about the buoyant member 103.

The upper connector 105 may be attached to a line connection member 106, to which the tow line 90 can be attached. In the illustrated embodiment, the upper connector 105 and the line connection member 106 comprise separate links of a chain. In other embodiments, one or more of the upper connector 105 and the line connection member 106 can comprise a carabineer or other suitable fastener.

Other suitable arrangements of the line connection members 106, 107 are also possible. For example, in some embodiments, the upper connector 105 can comprise a single link of a chain or other suitable device to which a tow line 90 can be attached, and a separate line connector 106 can be omitted. In some embodiments, the line connection member 107 comprises any suitable weighted device to which the line 91 can be secured. In other embodiments, the line connection member 107 is omitted and the lower connector 104 comprises a weighted element. In certain of such embodiments, the tow line 91 is directly coupled to the lower connector 104.

The upper and lower connectors 105, 104 can be spaced from each other along an axis that passes through the post 111. Such an orientation can ensure that the post 111 is rotated to substantially align the axis of the post 111 with the tow lines 90, 91 when they are under substantial tension, as provided by the moving watercraft 98 and towed participant 99 (see FIG. 2).

With reference to FIGS. 1-3, in operation, the device 100 can transition between the deployed orientation shown in FIG. 1 and the stowed orientation shown in FIG. 2. In the deployed orientation, the post 111 is maintained in a high-profile attitude. In the high-profile attitude, the signaling member 110 is maintained above the surface 80 of the water. In some instances, the device 100 can be in the deployed orientation whether substantially at rest in the water or whether being towed by the watercraft 98. For example, the device 100 may not be towed by the watercraft 98 when in the deployed state, such as when the motor of the watercraft 98 is disengaged. In such instances, there will be minimal to no tension in the tow lines 90, 91. Accordingly, the primary forces acting on the device 100 can be the downward force of gravity and the upward buoyant force provided by the water. When the system is in equilibrium, the chain or weight 112 can extend downwardly and be substantially beneath the buoyant member 103. Perturbations on the device 100, such as provided by wind or waves, may cause the post 111 and the signaling member 110 to be displaced from a vertical orientation. The weight 112 can prevent the post 111 from deviating from the vertical orientation significantly. It may be said that the upper portion of the post 111 that extends out of the water is maintained in a high-profile attitude relative to the surface 80 of the water. The weight 112 can counterbalance the upper end of the post 111 to maintain the post 112 in the high-profile attitude. By "high-profile attitude," it is meant that the upper end of the post 111 is maintained significantly out of the water in a manner that presents the ready visualization of the signaling member 110. For example, when in the high-profile attitude, the upper end of the post 111 is in a generally vertical orientation. By "generally vertical," it is meant that the upper end of the post 111 is within 45 degrees of true vertical in any direction.

In other instances, the device 100 may be in the deployed orientation as the device 100 is towed by the watercraft 98 via the tow line 90, such as for purposes of returning a distal end of the tow line 91 to the participant for further participation in the watersport. In such instances, tension (or linear resistance) in the tow line 91 may be substantially reduced because the participant is not being towed by the tow line 91. Although some tension may arise in the tow line 91, such as from drag on the tow line 91 as it is pulled through the water, such tension is significantly less than when the participant 99 is towed. In such instances, the device 100 can again maintain the upper end of the post 111 in the high-profile or generally vertical attitude to display the signaling member 110 or otherwise maintain the signaling member 110 at a position distanced form the surface 80 of the water.

In transitioning from the deployed orientation to the stowed orientation, tension in (or linear resistance on) the tow line 91 increases as the watercraft begins towing the participant 99. Due to the vertical spacing between the position at which the tow line 90 is attached to the device 100 (e.g., the position of the connector 106) and the position at which the tow line 91 is attached to the device 100 (e.g., the position of the connector 107), a significant torque is applied to a lower end of the post 111, which causes rotation of the post 111. This rotation urges the device 100 into the stowed state and causes the post 111 to assume a low-profile attitude. By "low-profile attitude," it is meant that the upper end of the post 111 and the signaling member 110 that is coupled thereto are maintained in a lowered state. When in the lowered state, the signaling member 110 may, in fact, be lower than it is when the post 111 is in the high-profile attitude. When in the low-profile attitude, the upper end of the post 111 is in a generally horizontal orientation. By "generally horizontal," it is meant that the upper end of the post 111 is within 45 degrees of true horizontal.

Stated otherwise, a portion of the post 111 that extends between the upper and lower connectors 105, 104 may be referred to as a tensioning member 115. The tensioning member 115 can communicate tension from the tow line 90 to the tow line 91 during towing of the participant 99. In the illustrated embodiment, an upper end of the tensioning member 115 is connected to the upper connector 105, which is in turn coupled to the tow line 90 (via the connection member 106), and the lower end of the tensioning member 115 is connected to the connector 104, which is in turn coupled to the tow line 91 (via the connection member 107). Torque applied at opposite ends of the tensioning member 115 via the tow lines 90, 91 causes the tensioning member 115 to rotate from an orientation that is substantially transverse to the tow line 90 substantially into alignment with both of the tow lines 90, 91. This, in turn, causes the upper end of the post 111 to likewise come substantially into alignment with the tow line 90 (see FIG. 2). Due to this alignment, the device 100 can be maintained in a low-profile attitude. Moreover, in some instances, substantially an entirety of the device 100 can be maintained substantially out of the water (i.e., above the surface 80 of the water) as the participant 99 is towed by the watercraft 98. By substantially out of the water, it is meant that the device 100 is maintained outside of the water during a significant portion (e.g., greater than 50 percent) of a towing period, although the device 100 may occasionally bob into and out of the water due to typical movements during a watersport.

An alternative description of FIGS. 1-3 is as follows. In certain embodiments, an arrangement of a safety signaling device can be positioned upon a buoyant platform and between a tow vessel and a watersports towable device or system. This signaling device can be deployed upon the participant becoming disassociated from the sport activity by the linear kinetic energy that arises during the towing process. As the linear kinetic energy arises in the signaling device, the device seeks equilibrium in a basic horizontal attitude. As the linear kinetic energy is released, a vertical attitude of the signaling device is resumed.

FIG. 1 illustrates one mode of a watersport participant 99 in a static mode. As no force is being applied to the tow rope the signal device of system 100 is in a generally vertical attitude allowing a signal device compatible with regulated statutes to be employed. FIG. 2 illustrates one mode of a watersport participant 99 in a dynamic mode. With tension applied to the tow rope from tow vessel 98, linear kinetic energy is introduced into the signaling device of system 100 and seeks equilibrium in a generally horizontal attitude. FIG. 3 depicts an embodiment of a signaling system 100 that can be operated between a tow vessel and a watersport participant. The signaling device of system 100 can include a signaling membrane 101 for the purposes of complying with regulated statutes regarding signaling that a watersport participant is disassociated from the tow vessel and in an elevated state of danger, an elongated appendage 102 of sufficient height and strength to support the signaling membrane, a buoyant member 103 of sufficient buoyancy and strength to support the signaling system 100, elongated securement 104 of sufficient strength to withstand the linear kinetic energy installed during the towing process and extending beyond the fastener securement 105 enabling the attachment of 102 to said protruding 104 fastener securement 105 of sufficient strength to withstand the linear kinetic energy installed during the towing process. In the illustrated embodiment, line connection 106 has an approximately 180 degree offset relative to line connection 107, which is attached to the elongated securement of 104 and receive a line connection either from the tow vessel or the watersports towable device or system. Line connection 107 can also include a ballast effect if additional stability of system 100 is desired. Offset angles other than approximately 180 degrees are also contemplated.

Figure 4:
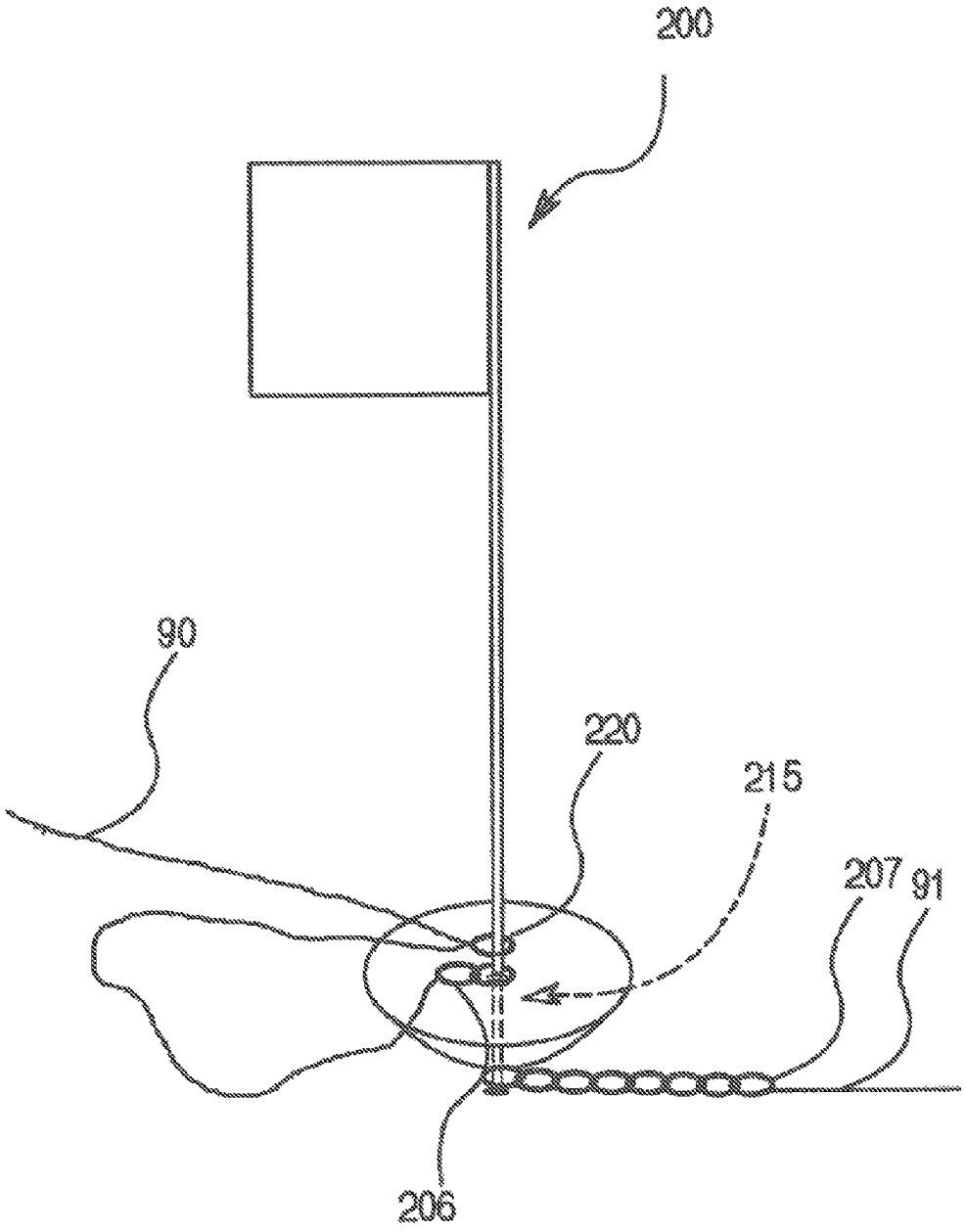
FIG. 4 is a perspective view of another embodiment of a signaling system similar to that of FIGS. 1-3 and further includes a control system that assists in moving a flag from a raised mode to a lowered mode, wherein the flag is depicted in the raised mode.
Figure 5:
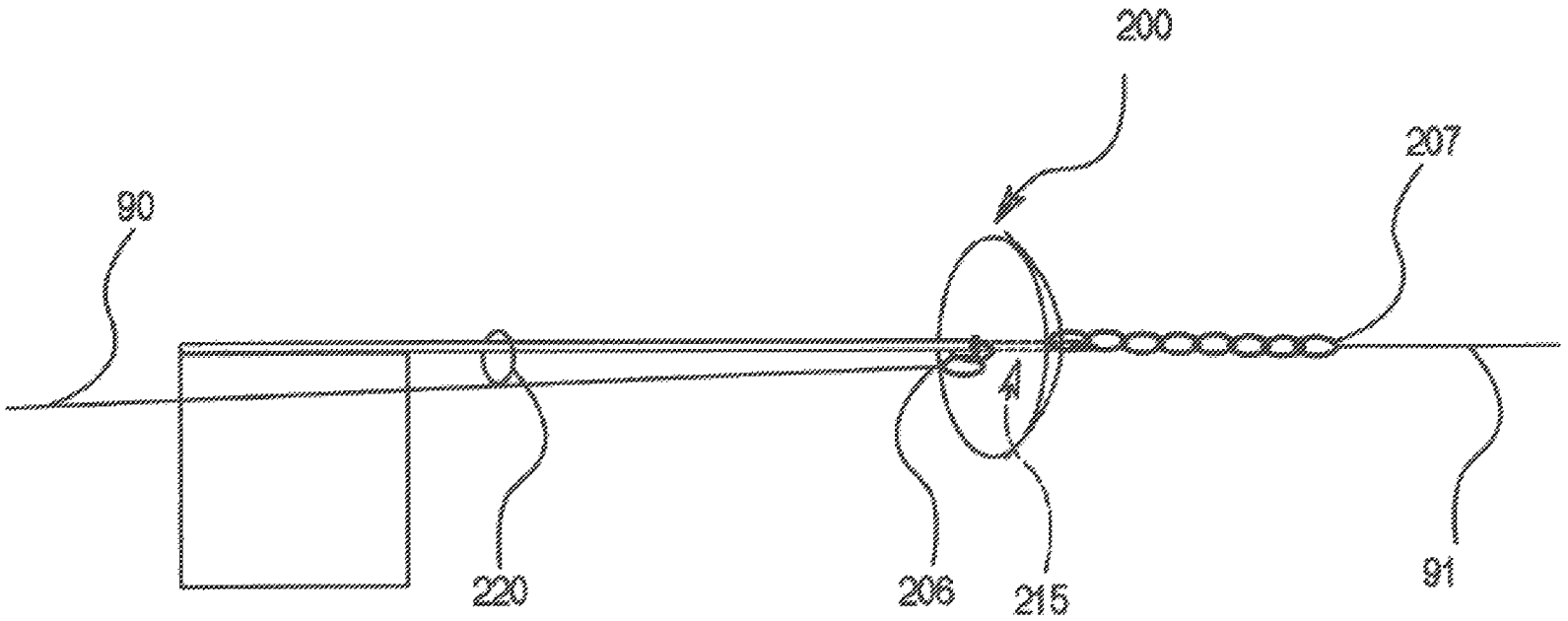
FIG. 5 is another perspective view of the signaling system of FIG. 4 with the flag depicted in the lowered mode.

FIGS. 4 and 5 depict another embodiment of an alerting device 200 that resembles the alerting device 100 in many respects. Accordingly, like features are designated with like reference numerals, with the leading digits incremented to "2." Relevant disclosure set forth above regarding similarly identified features thus may not be repeated hereafter. Moreover, specific features of the device 200 may not be shown or identified by a reference numeral in the drawings or specifically discussed in the written description that follows. However, such features may clearly be the same, or substantially the same, as features depicted in other embodiments and/or described with respect to such embodiments. Accordingly, the relevant descriptions of such features apply equally to the features of the device 200. Any suitable combination of the features and variations of the same described with respect to the device 100 can be employed with the device 200, and vice versa. This pattern of disclosure applies equally to further embodiments depicted in subsequent figures and described hereafter, wherein the leading digits may be further incremented.

The device 200 includes a retaining ring 220 attached to the tow line 90 at a fixed position. In some embodiments, the fixed position to which the ring 220 is attached can be at a length from a line connection member 206 that is less than the distance between a buoyant member 203 and a signaling membrane 201, as shown in FIG. 5. As can be seen by comparing FIGS. 4 and 5, the retaining ring 220 is configured to slide over a post 211 (e.g., a pole). As shown in FIG. 4, when there is little or no tension in the tow line 90, the ring 220 may slide down the pole and may rest on the buoyant member 203. As shown in FIG. 5, as tension on the tow line 90 increases, the retaining ring 220 is advanced along the post 211. This action can assist in transitioning the system 200 to and/or maintaining the system 200 in the stowed or flag-lowered orientation. Moreover, the retaining ring 220 can stabilize and/or reduce wear on the system 200. For example, the retaining ring 220 can maintain the longitudinal axis of the post 211 substantially parallel to that of the tow line 90 when the tow line 90 is under tension, thus preventing the pole and flag from careening relative to the tow line 90.

Figure 6:
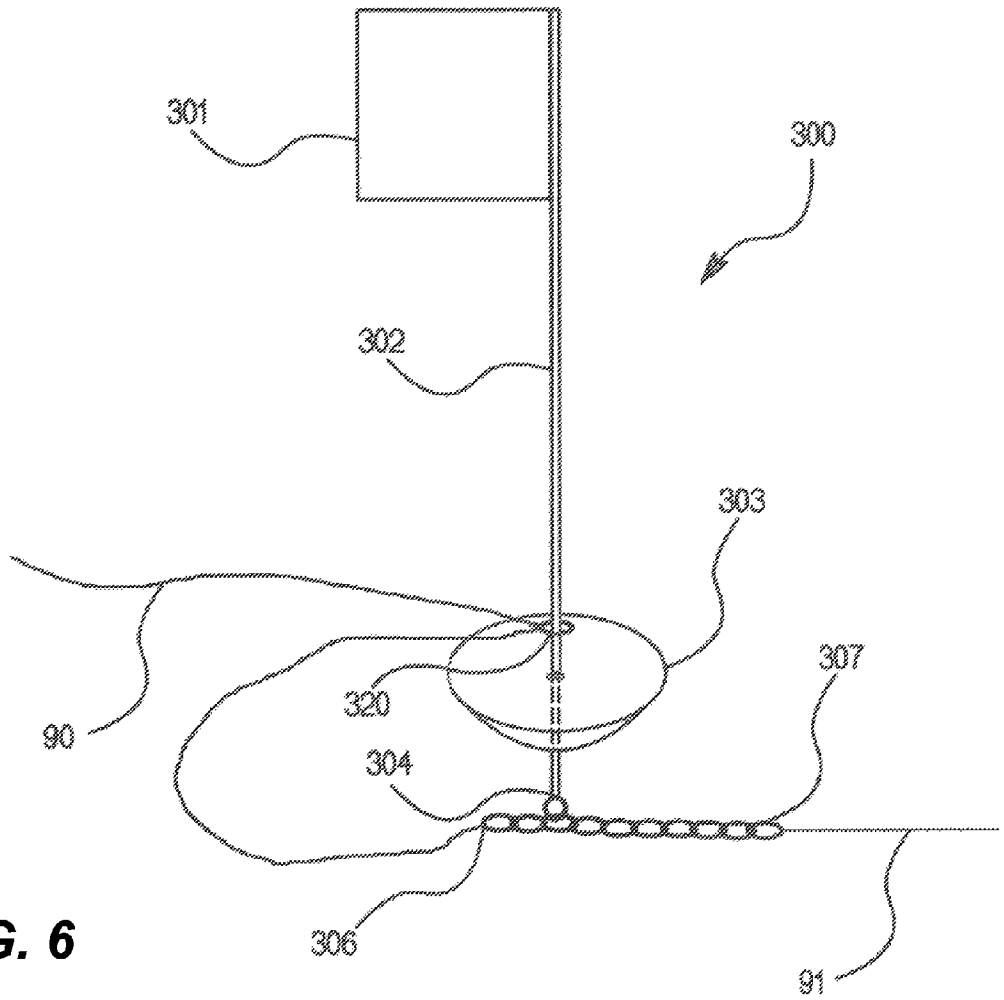
FIG. 6 is a perspective view of another embodiment of a signaling system.

FIG. 6 depicts another embodiment of an alerting device 300 that resembles the alerting devices 100, 200 in many respects. Rather than connecting the tow lines 90, 91 to upper and lower connectors 106, 107, respectively, as discussed above with respect to the device 100, the tow lines are instead connected to opposite ends of a weight 311, which is a chain in the illustrated embodiment. The weight 311 includes line connection members 306, 307 such as those discussed above. The weight 311 can be attached to the eye portion of an eyebolt 304, such as discussed above, or otherwise connected to a buoyant device 303 in any suitable manner. In the illustrated embodiment, the tow line 90 is connected to the watercraft 98 and the tow line 91 is held by the participant 99 during use (or otherwise tows the participant 99). When the flag is lowered to the stowed position, the flag extends forwardly along the tow line 90 and is retained in place via a ring 320 in manners such as discussed above and in a manner similar to that depicted in FIG. 5.

Figure 7:
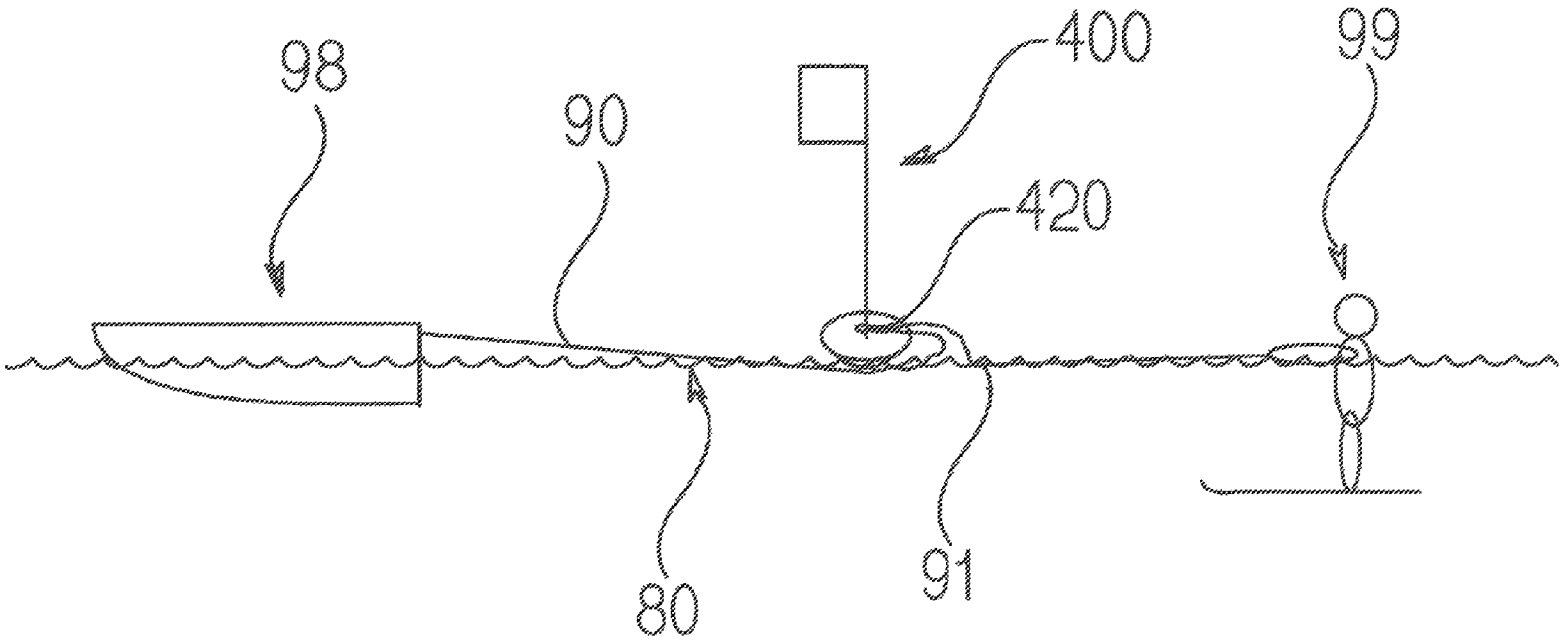
FIG. 7 is an elevation view of another embodiment of a signaling system in a deployed state.
Figure 8:
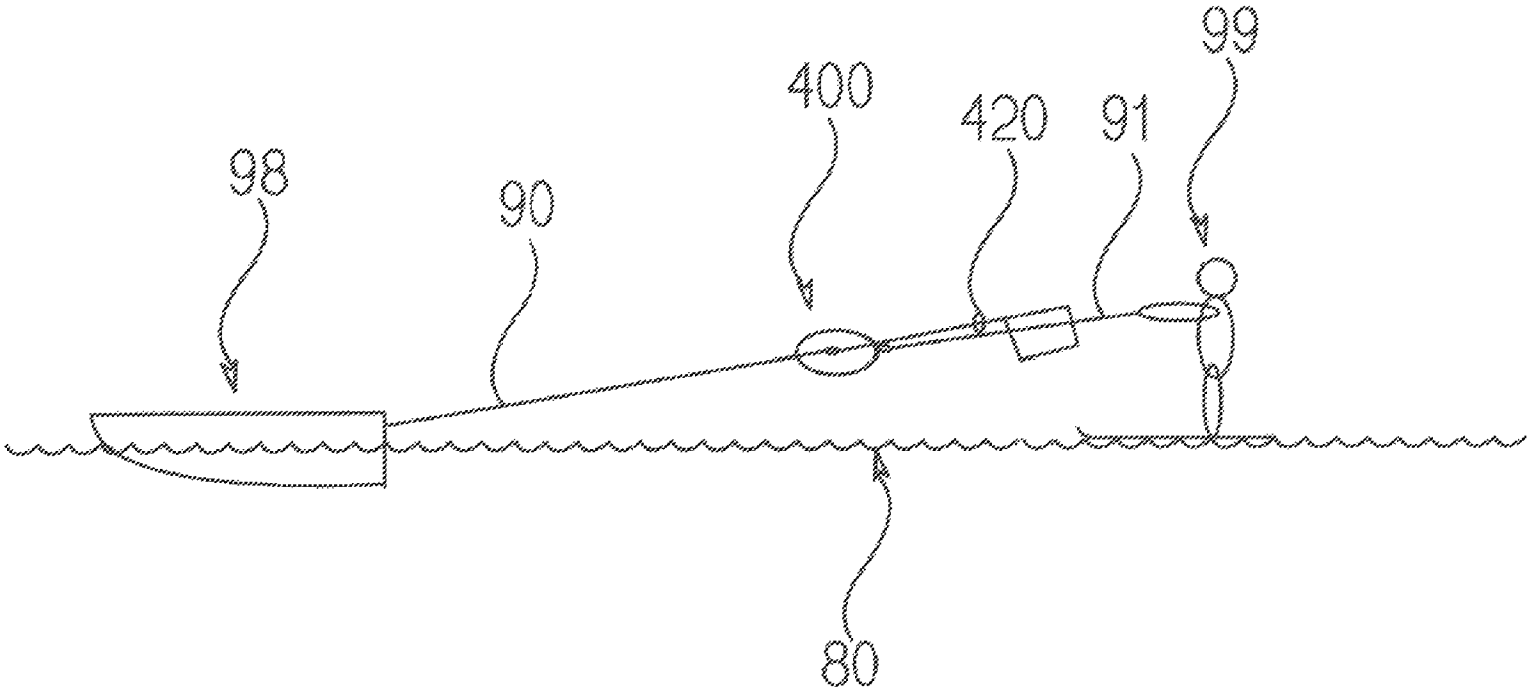
FIG. 8 is another elevation view of the system of FIG. 7 in a stowed state.

FIGS. 7 and 8 depict an embodiment of an alerting device 400 that resembles the alerting devices 100, 200, 300 in many respects. However, the flag is configured to be stowed in an opposite direction—e.g., is configured to extend toward the participant 99—during active towing, such as depicted in FIG. 8. In this embodiment, a retention ring 420 is attached to the tow line 91, rather than the tow line 90. The system 400 is particularly well-suited for biasing the flag to a raised orientation when the participant 99 is not being towed, particularly when the watercraft 98 continues to move through the water after the participant 99 has fallen or is otherwise downed. For example, in some embodiments, a sudden release of resistance in the tow line 91 when the participant releases the towline will project the device 400 forward and significantly reduce tension in the tow line 90. The flag will move to an upright position in manners such as previously discussed. Moreover, with the attachment point of the tow line 90 to the device 400 being predominantly at water-level (e.g., at the water surface 80), a slight upward incline toward the vessel 98 will exist in the line 90. This upward incline will provide a mechanical lift upon the leading edge of the buoyant device 103 (e.g., floatation disc), thus assisting in a water plane effect causing the device 400 to skip over the water and encouraging a waiving effect of the flag. The weight 111 (e.g., chain) drags behind, acting as a ballasting rudder.

Other embodiments are also contemplated. For example, the components of any of the foregoing embodiments may be suitably combined to form additional embodiments. In some embodiments, a single tow line may be used, rather than two individual tow lines 90, 91. For example, with reference to FIG. 6, in some embodiments, the single tow line may be attached to the loop 304 and the weight 311 may be separate from the tow line and also individually attached to the loop 304.

In some embodiments, the signaling device employs one or more lights or audible sounds when in the deployed configuration. In some embodiments, the flag may include additional markings, such as may be used for marketing.

In some embodiments, the buoyant member 103 comprises a thick disk of foam. For example, the disk can comprise a plastic-coated disk of closed-cell rigid polyethylene foam. In some embodiments, the disk is 10 inches in diameter and 2 inches thick. Other materials, configurations, and dimensions are also contemplated.

In some embodiments, the orientation of the buoyant member remains substantially constant regardless of the amount of tension in the tow line. For example, the buoyant member can comprise a pivot about which the elongated appendage can rotate.

In the embodiments discussed above, it can be seen that the tension that arises in the tow line automatically causes the device to move to the stowed state. This is true of embodiments in which two tow lines are attached at top and bottom ends of the buoyant member, respectively, and thus cause the buoyant member to pivot when the tow lines are pulled taut. This is also true of embodiments in which the retention rings 220, 320, 420 are attached to either of the tow lines 90, 91 such that the retention rings 220, 320, 420 each pull the flag and pole into the stowed position when tension increases on the lines 90, 91.

Figure 9:
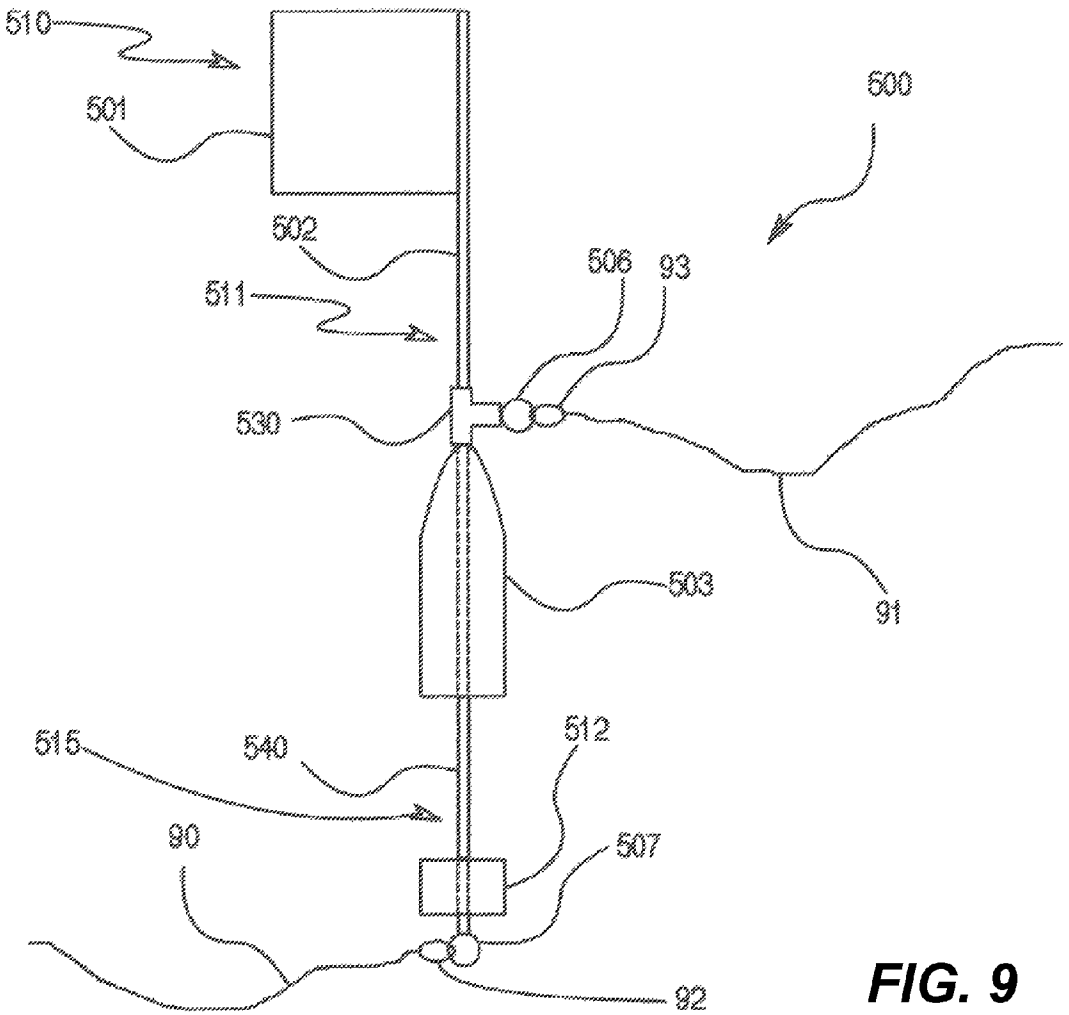
FIG. 9 is an elevation view of another embodiment of a signaling system.

FIG. 9 depicts another embodiment of an alerting device 500 that resembles the alerting devices previously disclosed. The alerting device 500 includes a signaling member 510 (e.g., a flag 501) coupled to a post 511. The post 511 includes an upper member 502 and a lower member 540. In some embodiments, the lower member 540 is permanently secured to a connector 530 and the upper member 502 is removably secured to the connector 530 in any suitable manner. For example, the lower member 540 may be permanently secured to the connector 530 via welding, adhesive, and/or any other suitable securement method. The upper member 502 may be secured to the connector 530 via threading or any other suitable attachment/detachment interface. The ability to selectively attach and detach the upper member 502 to/from the connector 530 can facilitate shipment of the device 500 in a disassembled state. Additionally or alternatively, it can permit more compact storage of the device 500 when not in use. In other embodiments, the connector 530 may be secured to a unitary pole that defines both the upper portion 502 and the lower portion 540 of the post 511.

In some embodiments, it may be desirable for the connector 530 to be securely fastened to at least the lower member 540 of the post 511 because these pieces may be subject to high tension during towing. For example, the lower member 540 may be a tensioning member 515 that communicates tension between the towing line 90 and the towing line 91.

In some embodiments, the connector 530 is attached to an upper connector 506 for attachment to the towing line 91. The attachment may be achieved in any suitable manner, such as via a standard connector 93. Similarly, a lower connector 507 may be provided at the lower end of the post 511 for attachment to the towing line 90. The attachment may be achieved in any suitable manner, such as via a standard connector 92.

The device 500 can include a buoyant member 503, which can function in manners similar to those discussed above. The illustrated buoyant member 503 is narrower than those of prior embodiments, and thus may define a lower profile relative to the tow line 90 when in the stowed orientation. An upper end of the buoyant member 503 may be rounded or otherwise shaped aerodynamically to reduce drag during towing.

The device 500 can include a weight 512. The weight can serve to counterbalance the upper end of the post 511 when the device 500 is in the deployed state, in manners such as previously discussed.

Figure 10:
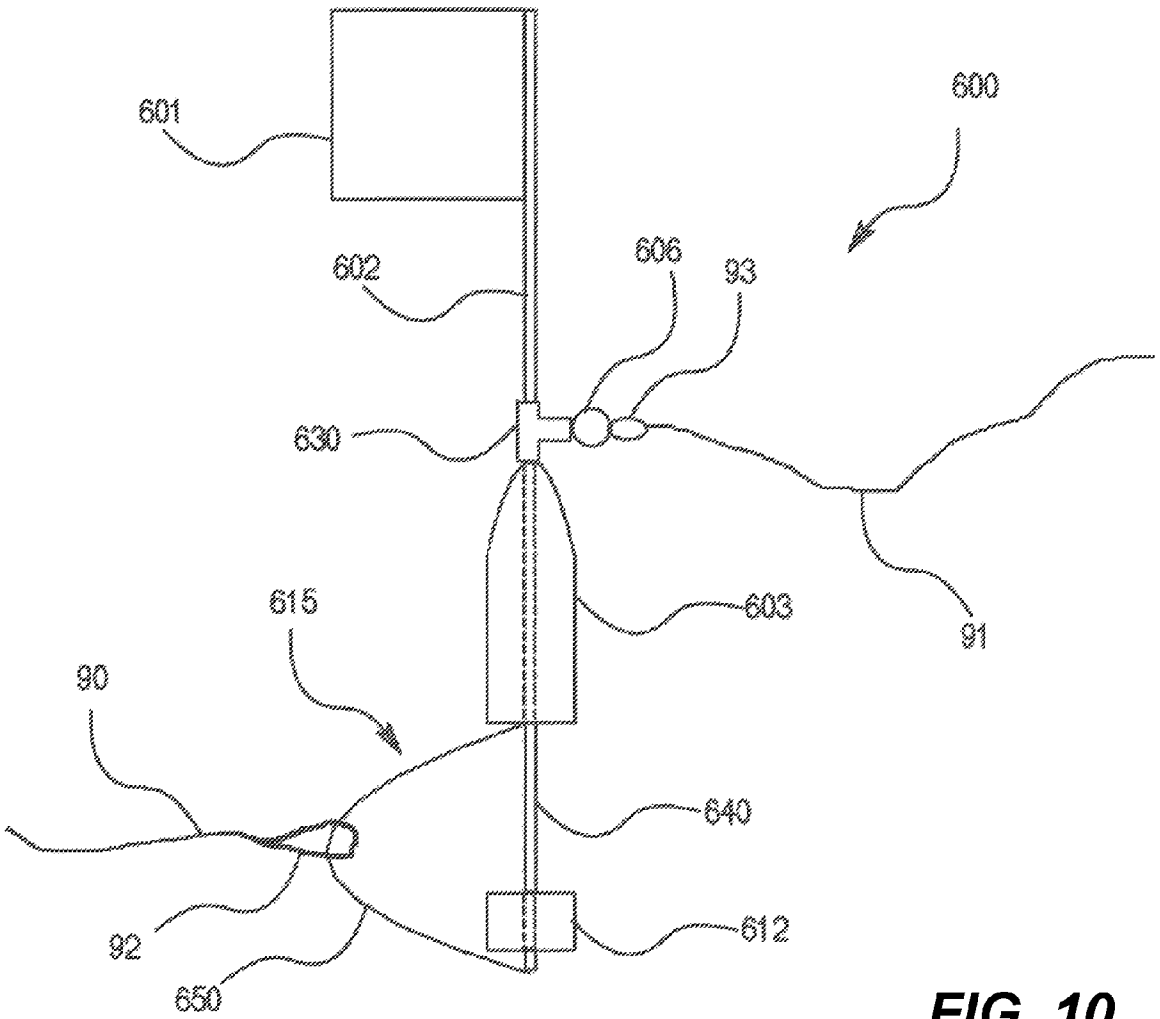
FIG. 10 is an elevation view of yet another embodiment of a signaling system.
Figure 11:
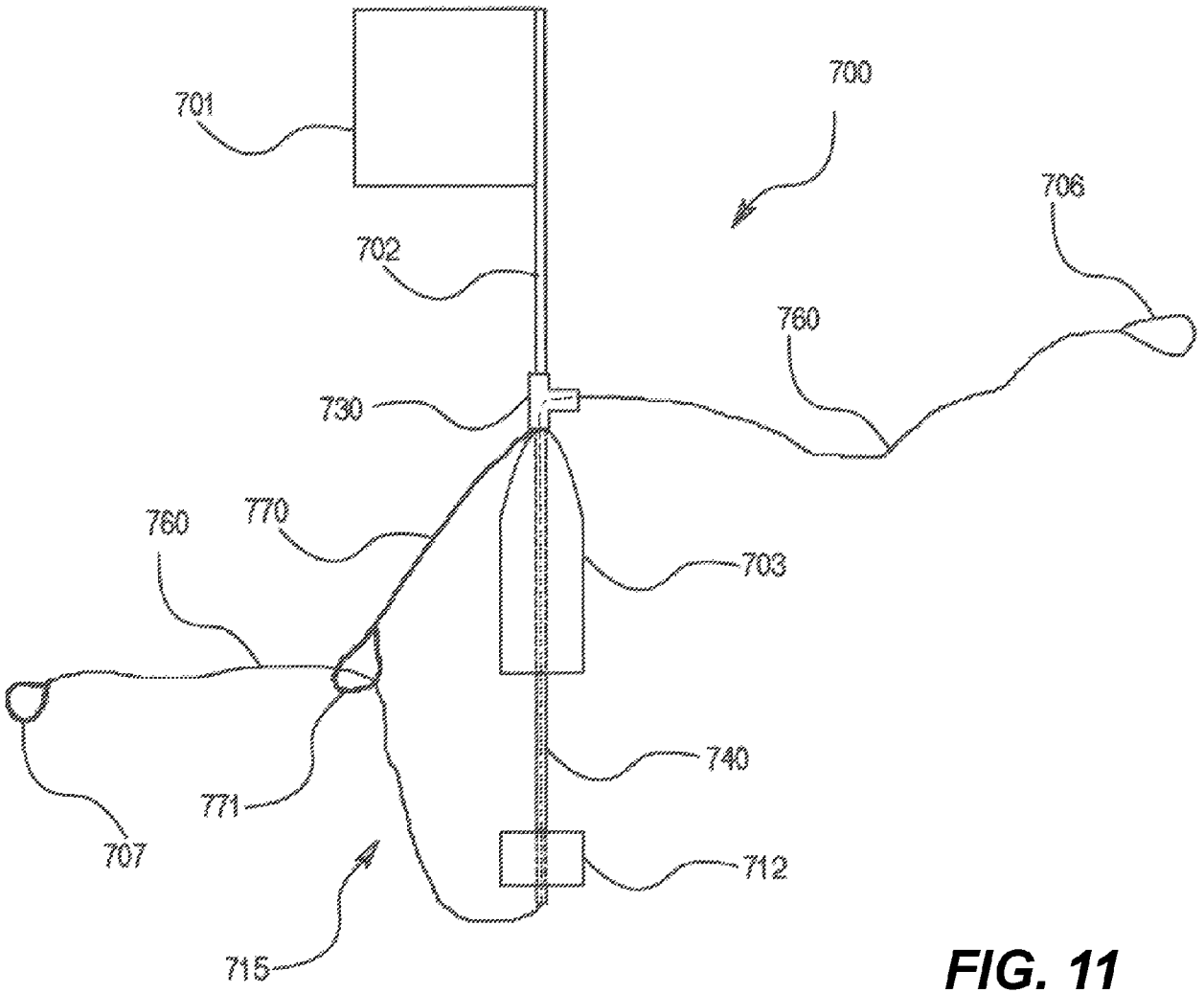
FIG. 11 is an elevation view of yet another embodiment of a signaling system.

FIG. 10 depicts another embodiment of an alerting device 600 that resembles the alerting devices previously disclosed. The alerting device 600 includes a signaling member, such as a flag 601, coupled an upper pole 602, or post. A lower pole 640 is permanently secured to a connector 630, whereas the upper pole 602 is removably secured to the connector 630 in any suitable manner. The connector 630 is attached to an upper connector 606 for attachment to the towing line 91 via a connector 93. A weight 612 is secured to the lower pole 640.

Attached to the lower pole 640 is a tensioning line or tow line 650. The tow line 650 is secured to the lower pole 640 at a bottom end thereof and also just below a buoyant member 603 (through which the lower pole 640 extends). The tow line 90 can be coupled with the tow line 650 via a connector 92. In some embodiments, the connector 92 is a typical connector, and the tow line 650 may be configured to loosely pass through an opening defined by the connector. In other embodiments, the connector 92 fixedly secures the tow lines 90, 650 to each other.

The tow line 650 can expand to the configuration shown in FIG. 10 when the device 600 is being towed by the tow line 90 and is in the deployed or raised configuration. With the connection point of the tow line 90 to the device 600 being relatively higher than it is for the device 500, the device 600 can be maintained in the upright orientation more easily during such towing. Stated otherwise, the moment arm of the lower end of the device 600 is smaller, and thus subject to a reduced torque.

During active towing of the participant 99, the device 600 can rotate into the stowed orientation in manners such as discussed above. Tension between the tow lines 90, 91 can be communicated through the tow line 650 and the lower pole 640 (as well as the connectors 630, 606, 93). Accordingly, the lower pole 640 and the tow line 650 can cooperate to define a tensioning member 615. When the device 600 is in the deployed state, the lower pole 640 is maintained substantially in a high-profile attitude. Further, when the device 600 is in the deployed state, the lower pole 640 is substantially transverse to the towing line 90, or stated otherwise, is substantially transverse to a direction of travel.

FIGS. 11-14 depict another embodiment of an alerting device 700 that resembles the alerting devices previously disclosed. The alerting device 700 includes a signaling member, such as a flag 701, coupled an upper pole or post 702. The post 702 is coupled to a connector 730 in any suitable manner. A lower pole 740 is also secured to a connector 730 in any suitable manner. For example, in the illustrated embodiment, the post 702 and the lower pole 740 are each secured to the connector 730 in a selectively coupled arrangement, such as via threading or any other suitable connection interface. Such selective coupling of the post 702 and the lower pole 740 to the connector 730 can permit the device 700 to be disassembled into a lower profile for packaging and/or storage. The device 700 likewise may be quickly assembled for use.

In the illustrated embodiment, a weight 712 is secured to the lower pole 740. The connector 730 is permanently secured to a buoyancy member 703. The buoyancy member 703 can define a cavity through which the lower pole 740 is inserted for coupling with the connector 730. A stabilizing tether 770 can be secured to the connector 730 and the buoyancy member 703. In some embodiments, the stabilizing tether 770 includes a connector 771.

The device 700 includes a tow line 760 that includes connectors 706, 707 at opposite ends thereof. In the illustrated embodiment, the tow line 760 extends through the connector 730 and the lower pole 740. In some embodiments, the tow line 760 is fixedly secured to one or more of the connector 730 or the lower pole 740, such as via an adhesive and/or in any other suitable manner. The tow line 760 thus serves to communicate tension between the tow line 90 and the tow line 91. As can be appreciated from FIGS. 11-13, when the device 700 is in the deployed orientation, a portion of the tow line 760 that extends through the lower pole 740 is substantially vertical. When tension on the tow line 760 increases, this portion of the tow line 760 is rotated to a substantially horizontal orientation as the tow line 760 is brought substantially into alignment with the tow lines 90, 91. The tow line 760 serves as a tensioning member 715 of the device 700.

Figure 14:
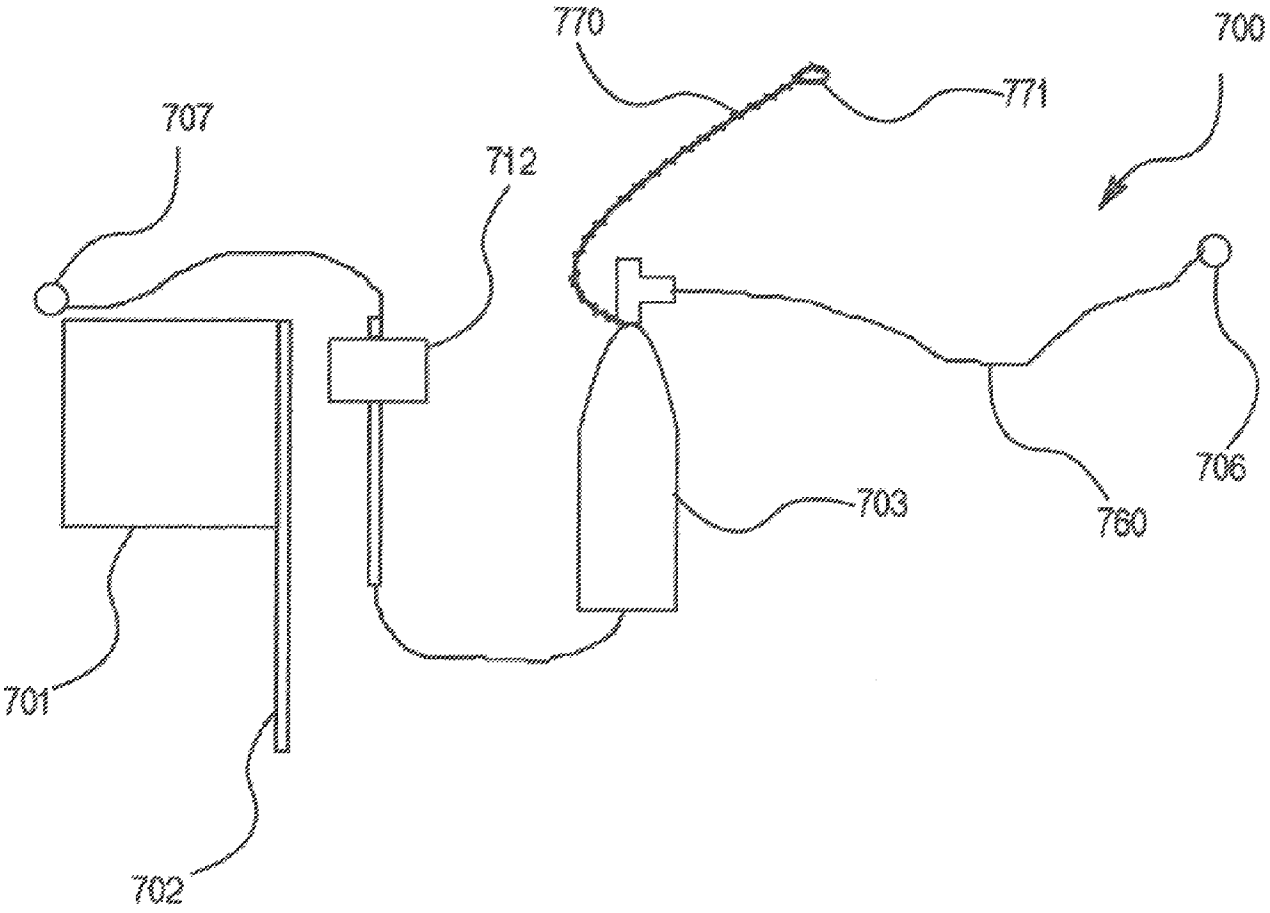
FIG. 14 is an elevation view of the signaling system of FIG. 11 shown in a disassembled state.

With reference to FIG. 14, various components of the device 700 are attached to each other in sub-assemblies that can readily be combined to assemble the device 700 for operation. Other arrangements for coupling the various components of the device 700 into sub-assemblies for ready assembly and disassembly are contemplated.

Operation of the stabilizing tether 770 will now be described. In certain embodiments, the connector 771 of the tether 770 is a typical connector, such as a carabineer or the like, and the tow line 760 may be configured to loosely pass through an opening defined by the connector. The connector 771 may instead be a loop of material of which the stabilizing material 770 is formed, and may in like manner be configured to permit loose passage of the tow line 760. In some embodiments, the connector 771 fixedly secures the stabilizing tether 770 to the tow line 760.

Figure 12:
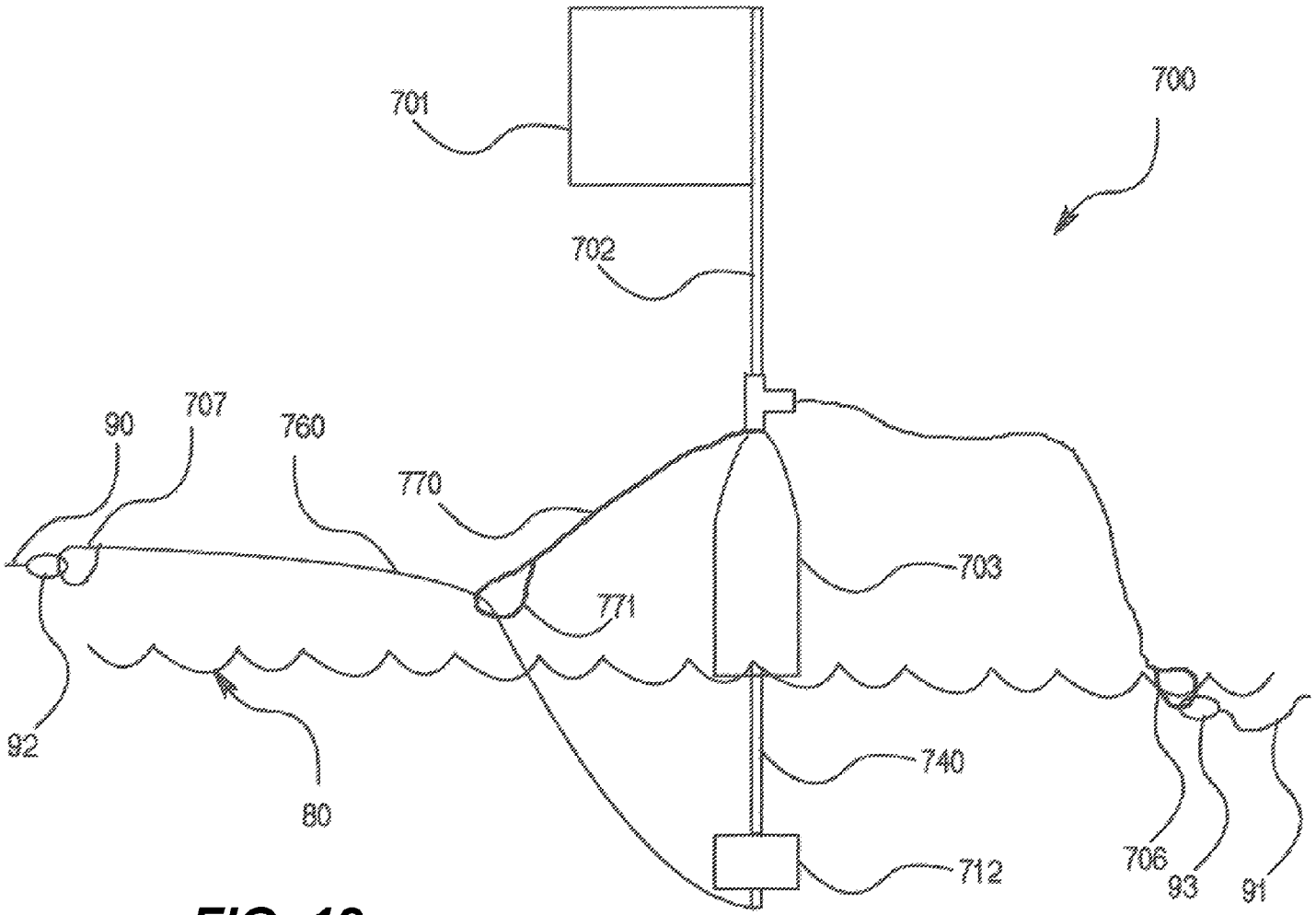
FIG. 12 is another elevation view of the signaling system of FIG. 11 shown coupled to two towing lines, wherein the signaling system is in a deployed state.
Figure 13:
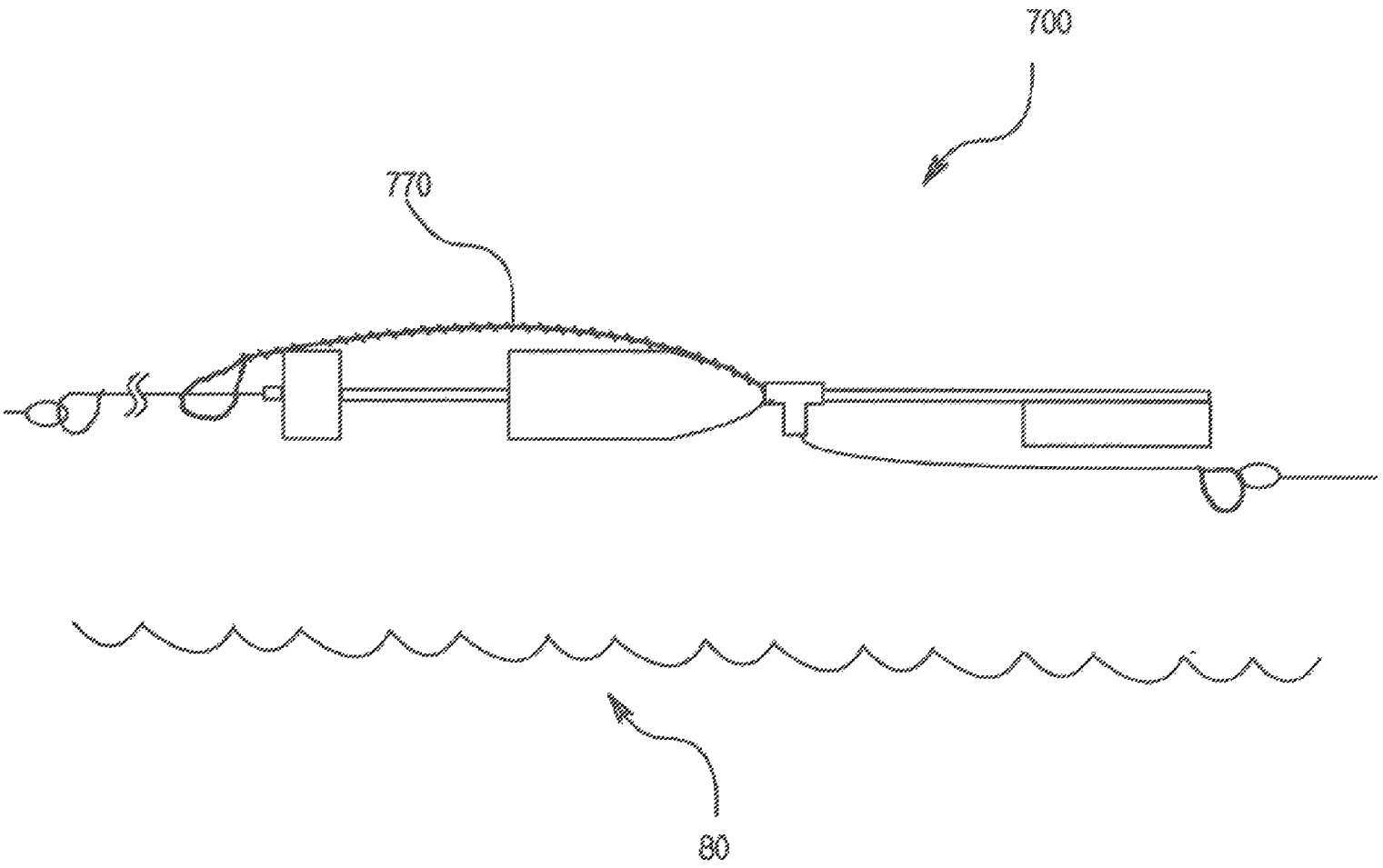
FIG. 13 is a further elevation view of the signaling system of FIG. 11 shown in a stowed state during towing.

The stabilizing tether 770 can assist in maintaining the post 702 in a high-profile attitude when the device 700 is in a signaling orientation and is being towed by the watercraft 98, such as shown in FIG. 12. Under such circumstances, tension in the tow line 760 pulls the stabilizing tether 770 radially outward and upward. When equilibrium is reached, the connector 771 can be roughly at or slightly above the surface 80 of the water. In some instances, forwardly directed force imparted by the tensioning line 90 (e.g., leftward force in the orientation shown in FIG. 12) thus can be applied roughly to a center of mass of the device 700 at the position of the connector 771, such that the device 700 can translate through the water with relatively little rotation.

Stated otherwise, the stabilizing tether 770 can transfer force from the tow line 90 so as to apply a torque at a portion of the device 700 that is above the water, while a portion of the tow line 760 that is at the bottom of the lower pole 740 below the water can apply an oppositely directed torque. These torques can counteract each other or achieve equilibrium in such manner as to yield little rotational movement of the pole 702. The pole 702 can thus be maintained in the high-profile attitude. In the illustrated embodiment, the stabilizing tether 770 applies torque at a position above the buoyant member 703. In other embodiments, the stabilizing tether 770 can apply torque at a different position relative to the buoyant member 703.

In some embodiments, the stabilizing tether 770 comprises a length of resilient material. In some instances, the resilient material can assist in counteracting fluctuations in torque at the lower end of the device 700 as it towed through the water. In some instances the resilient stabilizing tether 770 can stretch or elongate as the device 700 is transitioned to the stowing orientation shown in FIG. 13. The resulting stored potential energy may be released as tension in the towing lines 90, 91, 760 decreases, such that the resilient stabilizing tether 770 can assist in transitioning the device 700 rapidly into the deployed state.

Figure 15:
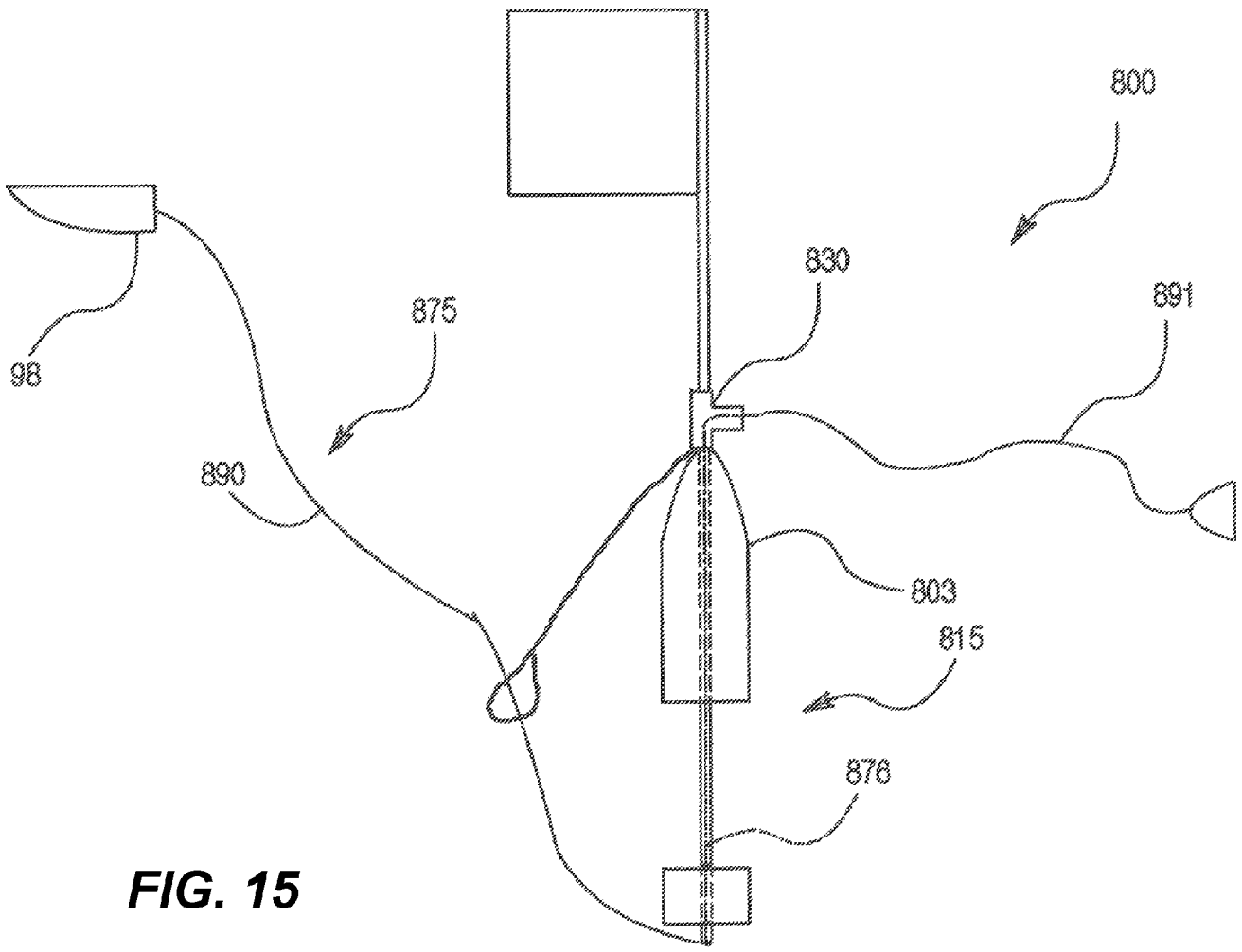
FIG. 15 is an elevation view of another embodiment of a signaling system that includes a single tow line.

FIG. 15 depicts another embodiment of an alerting device 800 that resembles the alerting devices previously disclosed, and in particular, resembles the alerting device 700. The alerting device 800 differs from the alerting device 700 primarily in its use of a single tow line 875, which includes a first length or branch 890 that extends between the watercraft 98 to the device 900 and a second branch 891 that extends from the device 900 to a distal end. In the illustrated embodiment, a handle is provided at the distal end of the tow line 875.

A third length or branch 876 of the tow line extends through a portion of the device 800 in the same manner that the tow line 760 extends through a portion of the device 700. The third branch 876 acts as a tensioning member 815 of the device 800. In some embodiments, the a portion of the device 800—e.g., a connector 830 and/or a buoyant member 803 of the device—is fixedly secured to the tow line 875. The alerting device 800 can function in the same manner as the alerting device 700 in all other respects.

Figure 16:
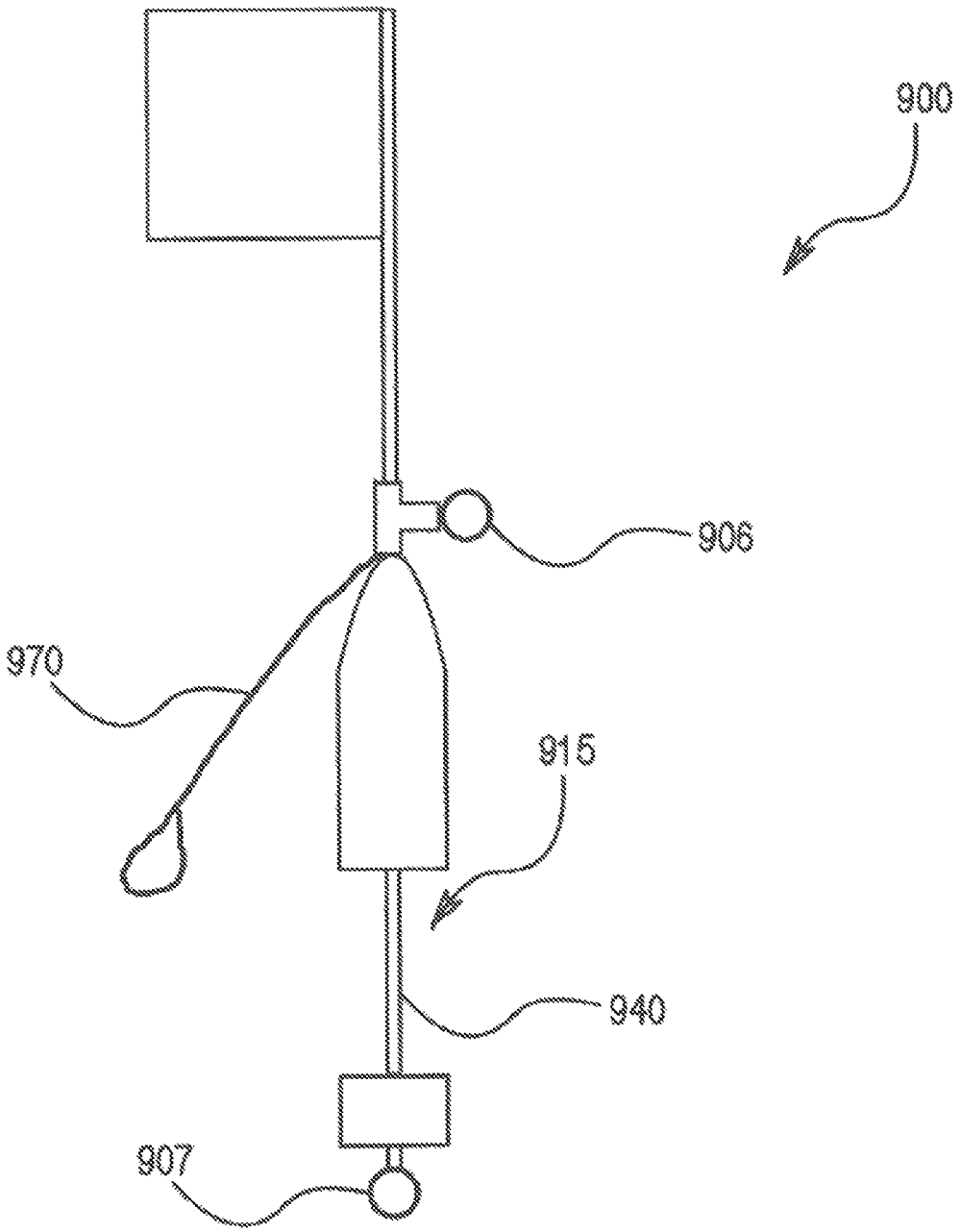
FIG. 16 is another embodiment of a signaling system.

FIG. 16 depicts another embodiment of an alerting device 900 that resembles the alerting devices previously disclosed, and in particular, resembles the alerting devices 500, 700, 800. The alerting device 900 differs from the alerting device 500 primarily in its use of a single stabilizing tether 970. The alerting device 900 differs from the alerting devices 700, 800 primarily in its use of a pole 940 as a tensioning member 915, rather than a separate tow line 760 (as does the device 700) or a length 876 of a tow line 875 (as does the device 800).

Any methods disclosed herein comprise one or more steps or actions for performing the described method. The method steps and/or actions may be interchanged with one another. In other words, unless a specific order of steps or actions is required for proper operation of the embodiment, the order and/or use of specific steps and/or actions may be modified.

References to approximations are made throughout this specification, such as by use of the terms "about" or "approximately." For each such reference, it is to be understood that, in some embodiments, the value, feature, or characteristic may be specified without approximation. For example, where qualifiers such as "about," "substantially," and "generally" are used, these terms include within their scope the qualified words in the absence of their qualifiers. For example, where the term "substantially vertical" is recited with respect to a feature, it is understood that in further embodiments, the feature can be precisely vertical.

Reference throughout this specification to "an embodiment" or "the embodiment" means that a particular feature, structure or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, as the following claims reflect, inventive aspects lie in a combination of fewer than all features of any single foregoing disclosed embodiment.

The claims following this written disclosure are hereby expressly incorporated into the present written disclosure, with each claim standing on its own as a separate embodiment. This disclosure includes all permutations of the independent claims with their dependent claims.

Recitation in the claims of the term "first" with respect to a feature or element does not necessarily imply the existence of a second or additional such feature or element. Elements specifically recited in means-plus-function format, if any, are intended to be construed in accordance with 35 U.S.C. §112(f). Embodiments of the invention in which an exclusive property or privilege is claimed are defined as follows.

The invention claimed is:

1. An alerting device for a water activity, the device comprising:

a buoyant member configured to maintain the alerting device afloat;

a post;

a signaling member coupled to the post; and a weight, the alerting device being attachable to one or more tow lines for towing a participant of a water activity via a watercraft such that the alerting device is spaced from each of the participant and the watercraft during said towing, the alerting device being configured to transition between a signaling orientation and a stowed orientation in response to tension changes within the one or more tow lines, the alerting device being in the signaling orientation under lower tension conditions in which the participant is not being towed via the one or more tow lines, and the alerting device being in the stowed orientation under higher tension conditions in which the participant is being towed via the one or more tow lines.

2. The alerting device of claim 1, wherein substantially an entirety of the alerting device is maintained out of the water via tension in the one or more tow lines when the participant is being towed via the one or more tow lines.

3. The alerting device of claim 1, further comprising a tensioning member via which tension is communicated from the watercraft to a portion of the one or more tow lines that is closest to the participant during towing of the participant.

4. The alerting device of claim 3, wherein the tensioning member comprises a length of tow line.

5. The alerting device of claim 4, wherein said length of tow line comprises a portion of said one or more tow lines.

6. The alerting device of claim 4, wherein said length of tow line comprises a tow line that is separate from the one or more tow lines, and wherein the tensioning member comprises one or more connectors via which the tensioning member is attachable to the one or more tow lines.

7. The alerting device of claim 4, further comprising a stabilizing tether configured to be coupled to the length of tow line.

8. The alerting device of claim 7, wherein the stabilizing tether is configured to assist in maintaining the upper end of the post in a generally vertical orientation when the alerting device is in the signaling orientation and is being towed by the watercraft.

9. The alerting device of claim 8, wherein the stabilizing tether is configured to apply torque to a portion of the alerting device that is positioned above a surface of the water when the alerting device is in the signaling orientation and is being towed by the watercraft.

10. The alerting device of claim 9, wherein the stabilizing tether is configured to apply torque at a position above the buoyant member when the alerting device is in the signaling orientation.

11. The alerting device of claim 7, wherein the stabilizing tether is configured to be coupled to the length of tow line via a connector through which length of tow line passes freely.

12. The alerting device of claim 7, wherein the stabilizing tether comprises a length of resilient material.

13. The alerting device of claim 1, further comprising:

a first connector configured to be attached to a first tow line to connect the alerting device to the watercraft; and a second connector configured to be attached to a second tow line via which the participant is towed.

14. The alerting device of claim 13, wherein the first and second connectors are at different vertical heights relative to a surface of the water when the alerting device is in the signaling orientation.

15. The alerting device of claim 14, wherein one of the first and second connectors is maintained at a position below the surface of the water and the other of the first and second connectors is maintained at a position above the surface of the water when the alerting device is in the signaling orientation.

16. The alerting device of claim 14, wherein the first and second connectors are at substantially the same vertical height above a surface of the water when the alerting device is in the stowed orientation.

17. The alerting device of claim 1, further comprising a retention ring coupled to the post and configured to be attached to the one or more tow lines, wherein movement of the retention ring relative to the post as tension increases in the one or more tow lines causes the post to rotate so as to be substantially parallel to the one or more tow lines.

18. The signaling device of claim 1, further comprising at least one of the one or more tow lines, wherein the signaling is device is attached to said at least one of the one or more tow lines.

19. An alerting device for a water activity, the device comprising:

a buoyant member configured to maintain the alerting device afloat;

a post; and a signaling member coupled to the post, the alerting device being attachable to one or more tow lines for towing a participant of a water activity via a watercraft such that the alerting device is spaced from each of the participant and the watercraft during said towing, the alerting device being configured to transition between a signaling orientation and a stowed orientation in response to tension changes within the one or more tow lines, the alerting device being in the signaling orientation under lower tension conditions in which the participant is not being towed via the one or more tow lines, and the alerting device being in the stowed orientation under higher tension conditions in which the participant is being towed via the one or more tow lines.

20. An alerting device configured to be attached to at least one tow line via which a watercraft tows a participant in a water activity, the device comprising:

a buoyant member;

a signaling member;

a weight; and a tensioning member coupled to the weight, the tensioning member being attachable to the at least one tow line such that the tensioning member is spaced from each of the watercraft and the participant during towing of the participant, the tensioning member being configured to communicate tension from the watercraft to a portion of the one or more tow lines that is closest to the participant during said towing, at least a portion of the tensioning member being configured to rotate between an orientation that is transverse to the at least one tow line and an orientation that is aligned with the least one tow line depending on an amount of tension in the at least one tow line, wherein the weight transitions the tensioning member into the transverse orientation when the participant is not being towed, the alerting device displaying the signaling member when the tensioning member is in the transverse orientation.

* * * * *